US011073349B2

(12) United States Patent
Carroll

(10) Patent No.: US 11,073,349 B2
(45) Date of Patent: Jul. 27, 2021

(54) FIREARM CONVERSION DEVICE

(71) Applicant: Aaron J. Carroll, Moseley, VA (US)

(72) Inventor: Aaron J. Carroll, Moseley, VA (US)

( * ) Notice: Subject to any disclaimer, the term of this patent is extended or adjusted under 35 U.S.C. 154(b) by 174 days.

(21) Appl. No.: 16/529,944

(22) Filed: Aug. 2, 2019

(65) Prior Publication Data

US 2019/0353439 A1 Nov. 21, 2019

Related U.S. Application Data

(62) Division of application No. 15/225,784, filed on Aug. 1, 2016, now Pat. No. 10,401,102.

(60) Provisional application No. 62/199,348, filed on Jul. 31, 2015.

(51) Int. Cl.
*F41A 3/68* (2006.01)
*F41A 3/66* (2006.01)

(52) U.S. Cl.
CPC . *F41A 3/66* (2013.01); *F41A 3/68* (2013.01)

(58) Field of Classification Search
USPC ..... 89/128, 138
See application file for complete search history.

(56) References Cited

U.S. PATENT DOCUMENTS

| | | | |
|---|---|---|---|
| 2,367,280 | A | 1/1945 | Hyde |
| 2,430,680 | A | 11/1947 | Jenkinson |
| 3,155,004 | A | 11/1964 | Weatherby |
| 3,330,183 | A | 7/1967 | Loffler |
| 4,220,071 | A | 9/1980 | Seiderman |
| 4,523,509 | A | 6/1985 | Thevis |
| 4,532,852 | A | 8/1985 | Hance |
| 4,703,826 | A | 11/1987 | Byron |
| 4,914,845 | A | 4/1990 | Reese |
| 4,930,239 | A | 6/1990 | Hunter |
| 4,936,035 | A | 6/1990 | Reese |
| 4,999,939 | A | 3/1991 | Reese |
| 5,131,317 | A | 7/1992 | Meller |
| 5,179,245 | A | 1/1993 | Straka |
| 5,339,721 | A | 8/1994 | Beretta |
| 6,125,735 | A | 10/2000 | Guhring |
| 6,212,814 | B1 | 4/2001 | Lambie |
| 6,510,778 | B1 | 1/2003 | Irwin |
| 6,851,346 | B1 | 2/2005 | Herring |
| 7,661,219 | B1 | 2/2010 | Knight |
| 8,117,957 | B2 | 2/2012 | Loganchuk |
| 8,225,705 | B2 | 7/2012 | Dubois |
| 8,261,652 | B2 | 9/2012 | Findlay |

(Continued)

*Primary Examiner* — Reginald S Tillman, Jr.
(74) *Attorney, Agent, or Firm* — Fish & Richardson P.C.

(57) ABSTRACT

A device for converting a semiautomatic firearm to a non-semiautomatic firearm. The device includes a bolt stop lever pivotally attachable to a receiver of a firearm, a spring configured to be installed in contact with the bolt stop lever and a firearm receiver such that the spring exerts a force on the bolt stop lever to retain the bolt stop lever in a first position, and, a bolt release mechanism operatively coupleable to the bolt stop lever and configured to pivot the bolt stop lever against the force of the spring into a second position. The bolt release mechanism is operatively decoupled from the bolt stop lever when the bolt stop lever reaches the second position. When in the first position the bolt stop lever restricts motion of a bolt of the firearm, and when in the second position, the bolt stop lever permits motion of the firearm bolt.

12 Claims, 12 Drawing Sheets

(56) References Cited

U.S. PATENT DOCUMENTS

| | | | | |
|---|---|---|---|---|
| 8,572,875 | B2 | 11/2013 | Sisgold | |
| 8,695,477 | B2 | 4/2014 | Esch | |
| 9,091,499 | B2 | 7/2015 | Overstreet | |
| 9,557,125 | B2 | 1/2017 | Stewart | |
| 2008/0121096 | A1 | 5/2008 | Hajjar | |
| 2011/0061523 | A1 | 3/2011 | Webb | |
| 2011/0146484 | A1 | 6/2011 | Landies | |
| 2011/0247482 | A1 | 10/2011 | Overstreet | |
| 2011/0247483 | A1 | 10/2011 | Overstreet | |
| 2018/0100714 | A1* | 4/2018 | Borders | F41A 17/42 |
| 2019/0128627 | A1* | 5/2019 | Christiansen | F41A 3/70 |

* cited by examiner

FIREARM CONVERSION DEVICE

CROSS-REFERENCE TO RELATED APPLICATIONS

This application is a divisional of U.S. application Ser. No. 15/225,784, filed Aug. 1, 2016, now allowed, which claims the benefit of U.S. Provisional Application No. 62/199,348, filed on Jul. 31, 2015, both of which are incorporated herein by reference in their entirety.

BACKGROUND

Semiautomatic firearms fire one round every time the trigger of the weapon is pulled. Such a weapon utilizes a portion of the energy of a firing cartridge or shell to extract the fired cartridge case or spent shell and chamber the next round. Several states have passed legislation regulating certain features of semi-automatic firearms. Currently possessed semi-automatic firearms that have more than the allotted number of regulated features usually must be altered, registered, or surrendered to law enforcement officials. As a result, firearm users living in or travelling to these states are often unsure about the legality of the firearms they possess.

Various attempts have been made to comply with firearms laws by altering the regulated features of these weapons. Such attempts generally involve removing or modifying one or more of the regulated features to bring particular firearms into compliance with the laws.

SUMMARY

This specification relates to systems and methods for converting a semiautomatic firearm to a non-semiautomatic firearm.

Implementations of the present disclosure generally convert a semiautomatic firearm to a non-semiautomatic firearm. A first aspect of the present disclosure includes a device for converting a semiautomatic firearm to a non-semiautomatic firearm, the device including a bolt stop lever pivotally attachable to a receiver of the semiautomatic firearm, a spring configured to be installed in contact with the bolt stop lever and the semiautomatic firearm receiver such that the spring exerts a force on the bolt stop lever to retain the bolt stop lever in a first position, and, a bolt release mechanism operatively coupleable to the bolt stop lever and configured to pivot the bolt stop lever, by a force applied to the bolt release mechanism, against the force of the spring and into a second position. The bolt release mechanism is operatively decoupled from the bolt stop lever when the bolt stop lever reaches the second position. When in the first position the bolt stop lever restricts motion of a bolt of the semiautomatic firearm, and when in the second position the bolt stop lever permits motion of the bolt of the semiautomatic firearm.

A second aspect of the present disclosure includes a device for converting a semiautomatic firearm to a non-semiautomatic firearm including a first housing, a bolt stop lever pivotally attached to the housing, a spring in contact with the bolt stop lever and the housing such that the spring exerts a force on the bolt stop lever to retain the bolt stop lever in a first position, and a bolt release mechanism operatively coupleable to the bolt stop lever and configured to pivot the bolt stop lever, by a force applied to the bolt release mechanism, against the force of the spring and into a second position. The bolt release mechanism is operatively decoupled from the bolt stop lever when the bolt stop lever reaches the second position. When in the first position the bolt stop lever restricts motion of a bolt of the semiautomatic firearm, and when in the second position the bolt stop lever permits motion of the bolt of the semiautomatic firearm.

Particular implementations of the subject matter described in this specification can be implemented so as to realize one or more of the following advantages. Implementations may make compliance with semi-automatic firearm regulations simpler and less expensive. Implementations may render currently owned semi-automatic firearms compliant with regulations by altering the function of the firearm regardless of other regulated features existing on the firearm. Implementations may convert a semiautomatic firearm into a non-semiautomatic firearm by replacing existing parts without requiring additional modifications to the firearm or firearm receiver. Implementations may be easily installed and uninstalled thereby allow permitting firearm owners to easily convert a semiautomatic firearm to a non-semiautomatic and vice versa as the owners travel between states with different regulations.

The details of one or more implementations of the subject matter described in this specification are set forth in the accompanying drawings and the description below. Other features, aspects, and advantages of the subject matter will become apparent from the description, the drawings, and the claims.

DESCRIPTION OF DRAWINGS

Like reference symbols in the various drawings indicate like elements.

DETAILED DESCRIPTION

Figure 1:
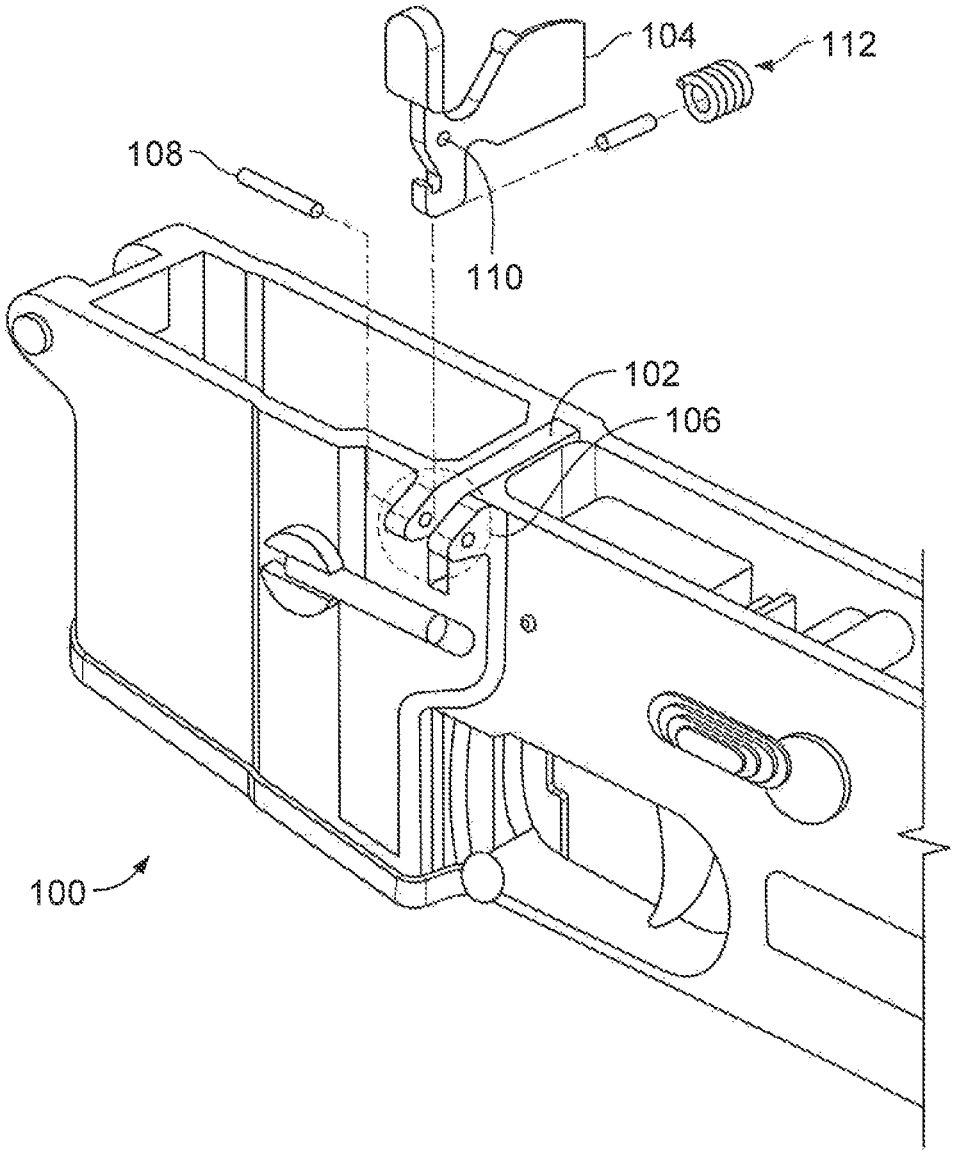
FIG. 1 illustrates an example semiautomatic firearm receiver with which implementations of the present disclosure may be used.

Implementations of the present disclosure are generally directed to converting a semiautomatic firearm into a non-semiautomatic firearm to comply with firearm regulations. In general, implementations of the present disclosure operate to prevent a bolt of the semiautomatic firearm from chambering a second round after a first round is fired. The bolt is released to chamber the second round upon receiving a user applied force to a bolt release mechanism operatively coupled to a bolt stop lever. Operatively decoupling the bolt release mechanism from the bolt stop lever after the bolt is released. And, preventing the bolt of the semiautomatic firearm from chambering a third round after the second round is fired.

The normal cycle of operations for a semiautomatic firearm begins with an unfired round (e.g., cartridge) in the chamber and the firearm in battery (e.g., the bolt in the forward position and the firearm cocked). When a user pulls the trigger, the hammer is released under spring pressure impacting a firing pin which strikes the primer of the live round, firing the round. A portion of the energy from the fired round is used to push the bolt in a rearward direction against spring pressure. As the bolt moves towards the rear, an extractor that is attached to the bolt grips onto the edge of the now empty shell casing and the casing is extracted by the rearward motion of the bolt. The empty shell casing is then ejected out of the firearm once it has been pulled out of the chamber. The bolt's rearward motion also cocks the firearm. The bolt is then pushed back forward under spring pressure. As the bolt moves forward it strips a new round off a magazine, and feeds the new round into the chamber. Implementations of the present disclosure convert a semiautomatic firearm into a non-semiautomatic firearm by interrupting this process and requiring a user to manually manipulate a mechanism in order to cause the firearm to chamber the new round after each shot.

For simplicity, implementations of the present disclosure will be described in reference to an AR style firearm (e.g., AR style firearms refers to a class of rifles and pistols modeled after firearm designer Eugene Stoner's original semiautomatic rifle design regardless of caliber such as AR-15, AR-10, AR-308, AR-9, AR-45, etc.), however, one skilled in the art would appreciate that one or more of the implementations described below also may be incorporated into other firearms that operate similarly (e.g., the M1A, M14, Mini-14, FN-FAL, etc.).

As used herein the term "semiautomatic firearm" refers to a firearm which automatically extracts a spent cartridge casing and chambers a new round after each shot. The semiautomatic firearm uses a portion of the energy from a firing round to extract a spent cartridge casing from the fired round, cock the firearm, and chamber a new round with each pull of the trigger, but requires a separate pull of the trigger to fire the new round.

As used herein the term "non-semiautomatic firearm" refers to a firearm which requires a user to manually manipulate some mechanism of the firearm to chamber a new round after each shot.

FIG. 1 illustrates an example semiautomatic firearm receiver 100 with which implementations of the present disclosure may be used. The receiver includes a slot 102 for accepting a bolt catch 104, and two protrusions 106, which serve as a pivot point for the bolt catch 104. The bolt catch 104 is installed within the slot 102 and retained in place with a pin 108 (e.g., a roll pin) that passes through two aligned holes in the protrusions 106 and a corresponding hole 110 in the bolt catch 104. During operation, the bolt catch 104 pivots about an axis at the pin 108. The bolt catch 104 functions to hold a bolt of the firearm in an open position. The spring 112 biases the bolt catch 104 into a lowered position such that the bolt is free to move within the firearm. The bolt catch may be pivoted to a raised position by either user supplied pressure or the internal follower of an empty magazine pressing upward from the magazine well, catching the bolt (e.g., the bolt and bolt carrier group in an AR and similar style firearms) in a rearward position and preventing further forward motion of the bolt. Although an AR style firearm receiver is shown and described, many different firearms include receivers and bolt catches that operate similarly (e.g., the M1A, M14, Mini-14, FN-FAL, etc.).

Figure 2:
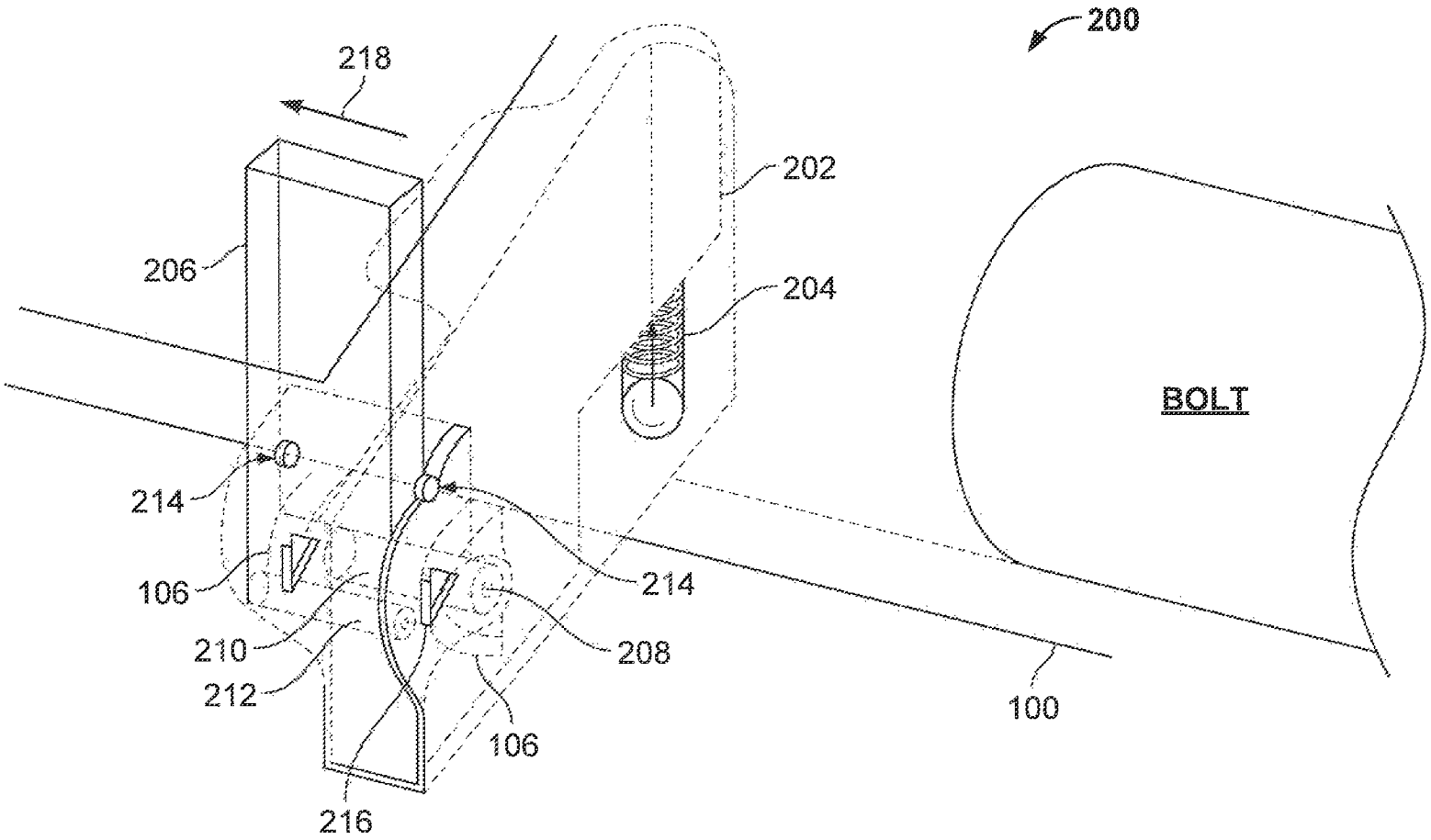
FIG. 2 illustrates an example implementation of a device for converting a semiautomatic firearm to a non-semiautomatic firearm.

FIG. 2 illustrates an example implementation of a device 200 for converting a semiautomatic firearm to a non-semiautomatic firearm. The device 200 includes a bolt stop lever 202, a base spring 204, and the bolt release mechanism 206. The bolt stop lever 202 is configured with a size and shape to be inserted within the bolt catch slot 102 of the receiver 100. The bolt stop lever 202 is pivotally attached to the receiver with a lever pivot 208 (e.g., a pin, a roll pin, screw, cotter pin, etc.) placed through the two protrusions 106 of the frame 100 and a hole 210 at one end of the bolt stop lever 202. The spring 204 is positioned between the bolt stop lever 202 and the receiver 100, and biases the bolt stop lever 202 in an upward position tending to stop the bolt of the firearm in the rearward or open position after each shot.

The bolt release mechanism is pivotally attached to the bolt stop lever 202 at a first end 212 and operatively coupleable to the bolt stop lever 202 by engagement devices 214. The engagement devices 214 are configured to remain engaged when a user pushes the bolt release mechanism 206 to release the bolt, and disengage once the bolt has been released. In other words, the engagement devices 214 remain engaged and transfer a force applied by the user from the bolt release mechanism 206 to the bolt stop lever 202. The bolt stop lever 202 is thereby pivoted against the pressure of the base spring 204, releasing the bolt. Once the bolt has been released, the engagement devices 214 disengage and the bolt release mechanism 206 pushes through the engagement devices 214 towards the receiver 100, either due to an increased counter pressure supplied by the compression of the base spring 204 or by the bolt stop lever 202 bottoming out on the receiver 100, thereby resetting the bolt stop lever 202 in the upward position. The engagement devices 214 are configured such that a user cannot hold the bolt stop lever 202 in the downward (bolt release) position while firing the firearm. The bolt release mechanism 206 must be reset after each shot.

Figure 3:
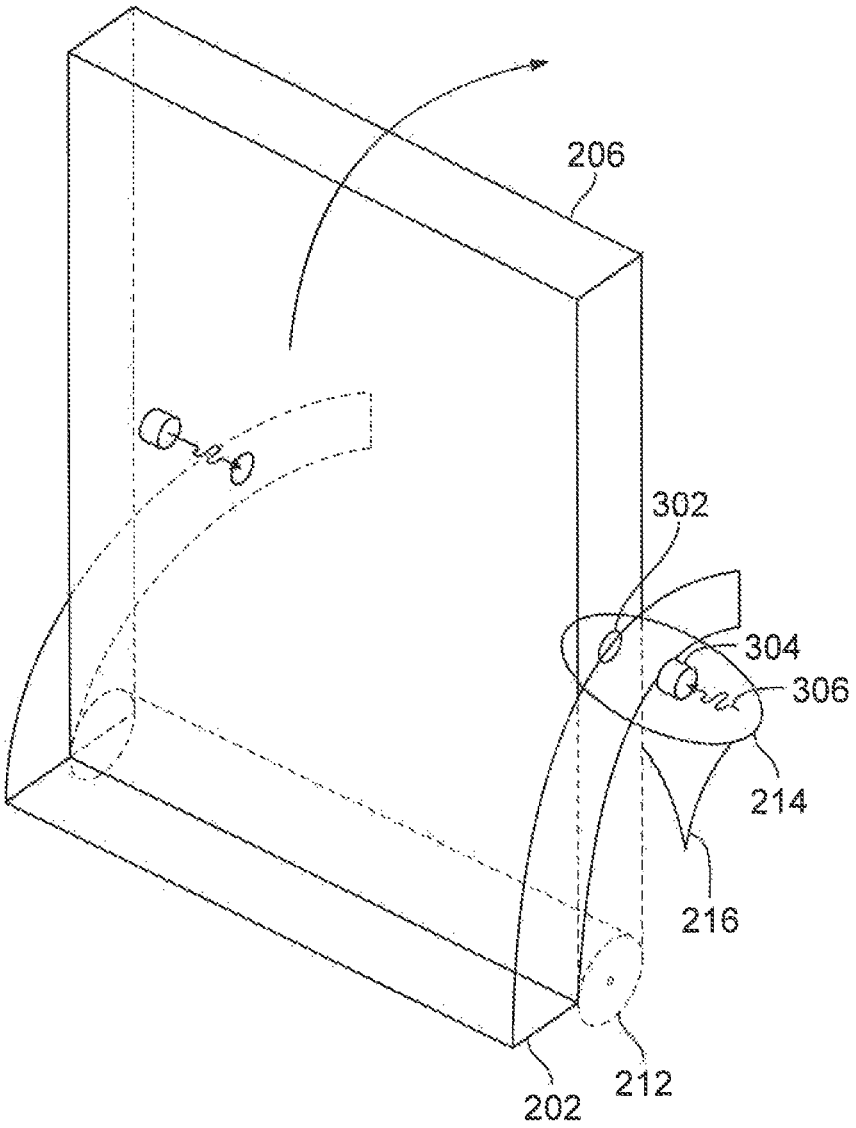
FIG. 3 illustrates an example operation of an example implementation of a device for converting a semiautomatic firearm to a non-semiautomatic firearm.

FIG. 3 illustrates a portion of an example implementation of a device for converting a semiautomatic firearm to a non-semiautomatic firearm. FIG. 3 shows the connection between the bolt stop lever 202 and the bolt release mechanism 206, as well as, the engagement devices 214 in more detail. The engagement devices 214 may, for example, be corresponding pairs of detents 302 and protrusions 304. For example, the bolt stop lever 202 may have a protrusion 304 and the bolt release mechanism 206 may have a corresponding detent 302. When aligned, the protrusion 304 engages with the corresponding detent 302 thereby, operatively coupling the bolt stop lever 202 and the bolt release mechanism 206. In some implementations, for example, the bolt stop lever 202 may have the detent 302 and the bolt release mechanism 206 may have the corresponding protrusion 304. In some implementations, the protrusions may be ball bearings under the pressure of a spring 306.

In some implementations, reset springs 216 are positioned between the bolt stop lever 202 and bolt release mechanism 206 to reset the bolt release mechanism 206 when the engagement devices 214 disengage.

Figure 4:
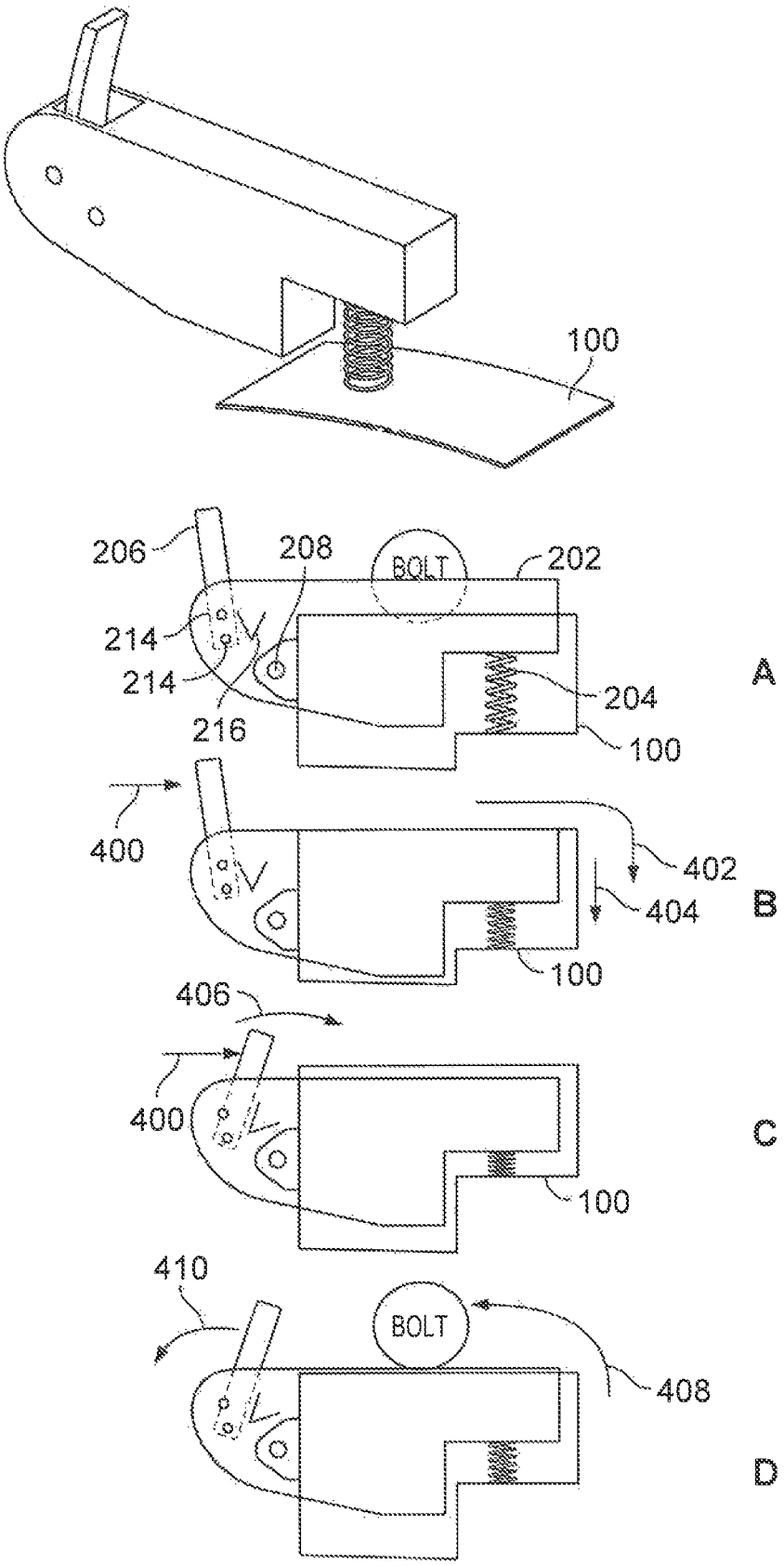
FIG. 4 illustrates a portion of an example implementation of a device for converting a semiautomatic firearm to a non-semiautomatic firearm.

FIG. 4 illustrates an example operation of an example implementation of a device for converting a semiautomatic firearm to a non-semiautomatic firearm. Diagram (A) shows device 200 and a rest position. The bolt stop lever 202 is pushed upward into the path of the bolt (e.g., the bolt and bolt carrier group in an AR and similar style firearms) by the force of the base spring 204. When the bolt is in the rearward position (as shown) the bolt stop lever 202 holds the bolt in the rearward position preventing the bolt from moving forward and feeding a new round into the chamber of the firearm. Also in the rest position the bolt stop lever 202 in the bolt release mechanism 206 are operatively coupled, that is, engagement devices 214 are engaged.

In diagram (B), a user force 400 is applied to the bolt release mechanism 206. The user force 400 pivots the bolt stop lever 202 against the pressure of base spring 204 in the direction of arrow 402. Thus, displacing the bolt stop lever 202 downward as indicated by arrow 404 below the bolt, and permitting the bolt to move forward and chamber a new round. In diagram (C), after the bolt is released, a counter force generated against the user applied force 400 by either the compressed base spring 204 or by the bolt stop lever 202 bottoming out against the receiver 100 causes the engagement devices 214 to disengage, operatively uncoupling the bolt release mechanism 206 from the bolt stop lever 202. As indicated by arrow 406, the bolt release mechanism 206 may then freely pivot and no longer transmits the user applied force 400 to the bolt stop lever 202.

In diagram (D), when the bolt release mechanism 206 is operatively decoupled from the bolt stop lever 202, the base spring 204 tends to pivot the bolt stop lever 202 back to the upward position. As the bolt travels forward and passes over top of the bolt stop lever 202, the bolt stop lever 202 is prevented from pivoting fully to its upward position. However, when the bolt is fully forward it will no longer be on top of the bolt stop lever 202 and the bolt stop lever 202 will pivot fully to its upward position. When the user fires the firearm, the bolt will return to its rearward position and as the bolt passes over the bolt stop lever 202 during the bolt's travel to the rear the bolt will depress the bolt stop lever 202 downward by applying force to the beveled face 218 of bolt stop lever 202. By the time the bolt has traveled completely to the rear and begun its forward travel, the bolt stop lever 202 will return fully to its upward position. In the upward position, the bolt stop lever 202 holds the bolt in the rearward position and again prevents the bolt from feeding a new round into the chamber since the rear of the bolt stop lever 202 is not beveled but straight. In order to chamber the next round the user will again have to apply a force 400 to the bolt release mechanism 206, as depicted in diagram (B). Thus, the formerly semiautomatic firearm must be operated as a non-semiautomatic firearm.

In some implementations, reset springs 216 may provide a force to reengage the bolt release mechanism 206 with the engagement devices 214 thereby, operatively re-coupling the bolt release mechanism 206 with the bolt stop lever 202, and resetting the bolt release mechanism 206.

Figure 5:
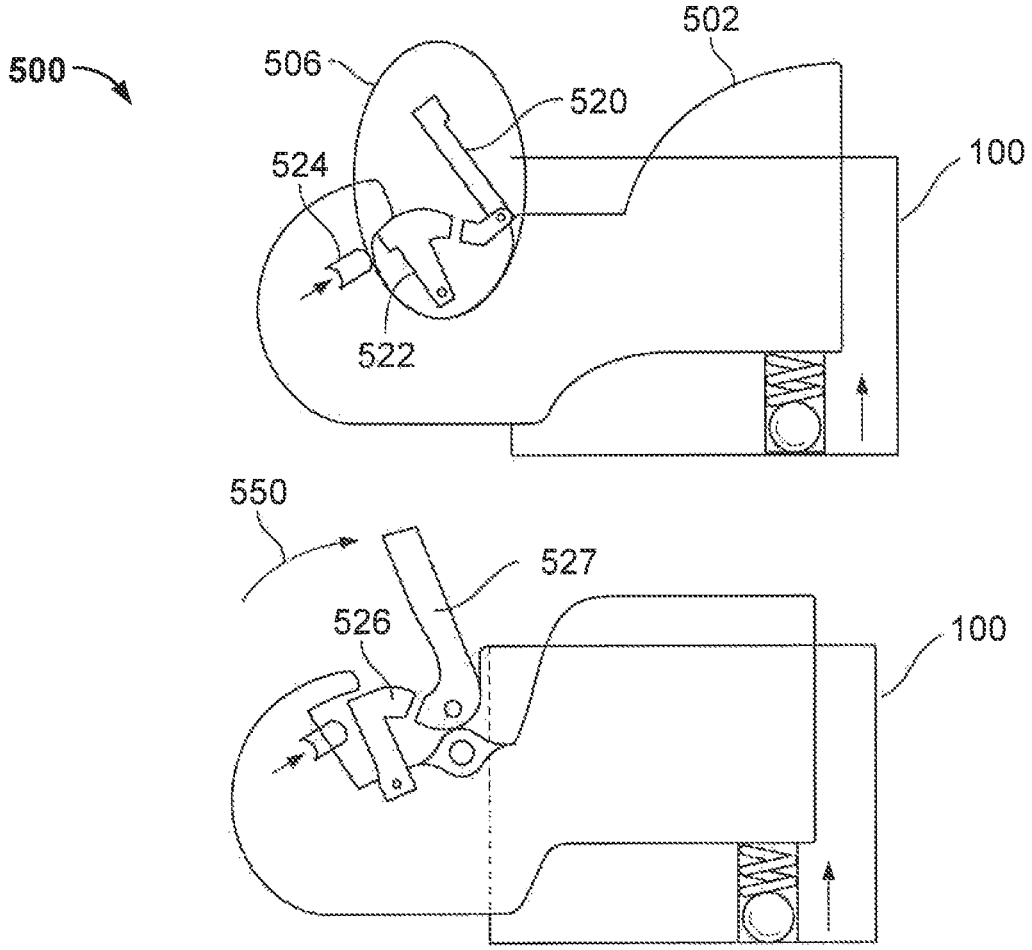
FIG. 5 illustrates a second example implementation of a device for converting a semiautomatic firearm to a non-semiautomatic firearm.

FIG. 5 illustrates a second example implementation of a device 500 for converting a semiautomatic firearm to a non-semiautomatic firearm. Device 500 is similar to device 200 shown in FIGS. 2-4, but shows an alternate implementation of a bolt release mechanism 506. In the illustrated implementation, the bolt release mechanism 506 is a two-piece design. The bolt release mechanism 506 includes a first member 520 and a second member 522, each pivotally attached to the bolt stop lever 502, and a spring 524. The first 520 and second 522 members are operatively coupled when the faces 526 and 527 of the first 520 and second 522 members are engaged, and thus the bolt stop lever 502 and bolt release mechanism 506 are also operatively coupled. As a user presses (indicated by arrow 550) on the first member 520 of the bolt release mechanism 506, the bolt stop lever 502 pivots and is lowered, and the spring 524 compresses permitting the second member 522 to pivot away from the first member 520. The spring 524 is of sufficient strength to maintain the faces 526 and 527 of the first 520 and second 522 members engaged until the bolt is released, but the faces 526 and 527 will disengage after the bolt is released.

Figure 6:
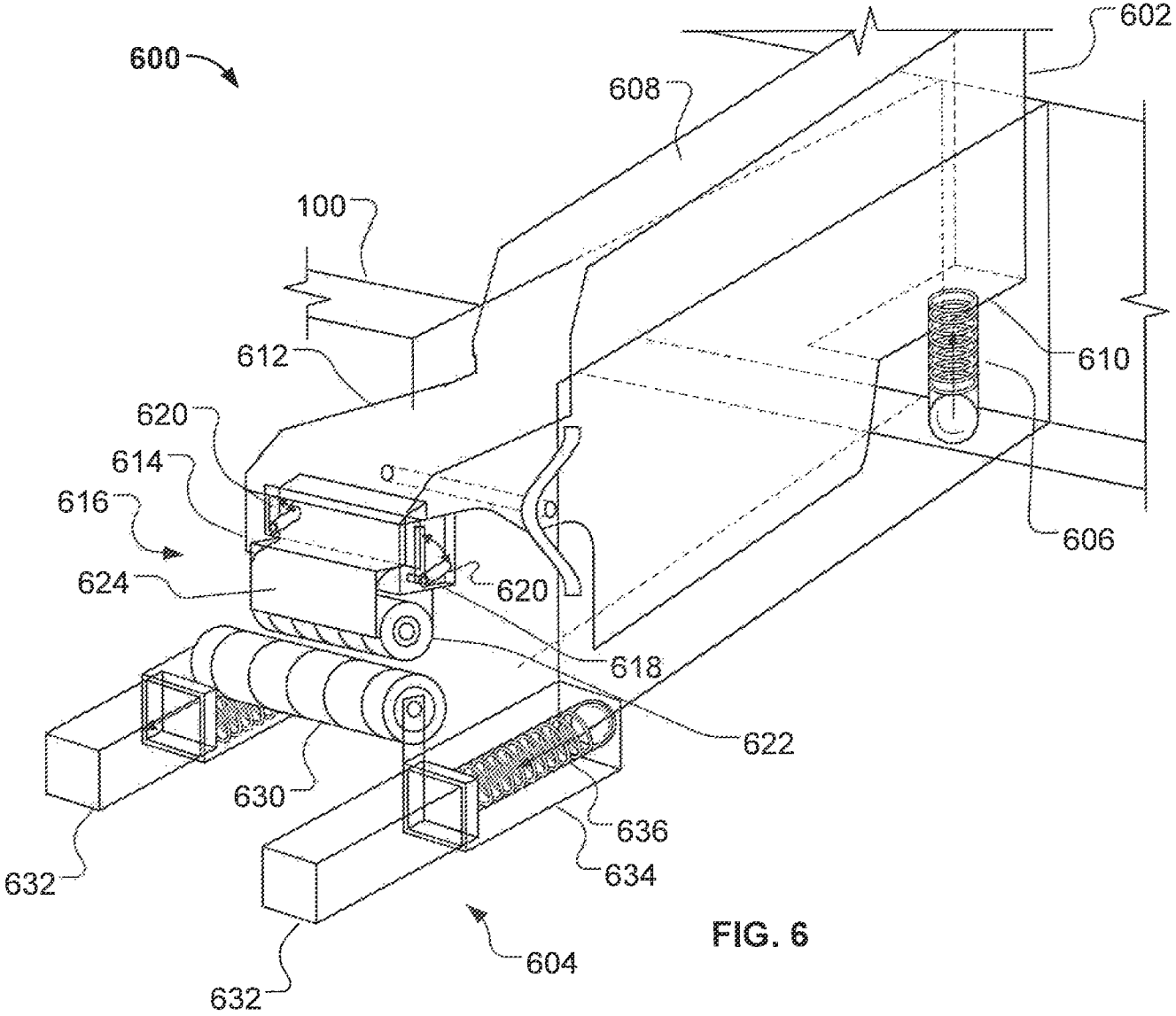
FIG. 6 illustrates a third example implementation of a device for converting a semiautomatic firearm to a non-semiautomatic firearm.

FIG. 6 illustrates a third example implementation of a device 600 for converting a semiautomatic firearm to a non-semiautomatic firearm. The device 600 includes a bolt stop lever 602, a bolt release mechanism 604, and a base spring 606 assembled within a device housing. The bolt stop lever 602 has a lever body 608, a lever body base 610, a lever body extension 612, a lever body extension arm 614, an upper roller assembly 616, and a hole at a first end of the bolt stop lever. The bolt stop lever is pivotally attached to the receiver 100 at the receiver protrusions by the lever pivot 618. The lever pivot 618 may be, for example, a pin, a roll pin, screw, cotter pin, etc., installed through holes in the receiver protrusions and the hole at the distal end of the bolt stop lever 602. In some implementations, the lever pivot 618 may be a semi-permanent or tamper proof pin.

The lever body 608 is the portion of the bolt stop lever that moves up and down inside the bolt catch slot of the receiver 100. For example, the lever body 608 is a flat piece that comes in contact with the bolt carrier group and prevents the bolt from moving to a forward position. The lever body base 610 is the lower portion of a cutaway second end of the lever body 608. The lever body base is substantially perpendicular to the direction of travel of the bolt inside of the receiver.

The base spring 606 applies upward pressure on the lever body 608 at the lever body base 610. The base spring 606 places enough upward pressure on the lever body to pivot the lever body 608 into a raised position above a plane of the receiver 100, and into the path of the bolt thereby preventing the bolt from moving forward and feeding a round in the chamber of the firearm.

The lever body extension 612 extends from the lever body outside of the bolt catch slot in the receiver. The lever body extension arm 614 extends downward from the lever body extension. An upper roller assembly 616 is attached to the lever body extension arm. The upper roller assembly 616 includes an upper roller housing pivotally attached to the lever body extension arm by an upper roller pivot (e.g., a pin, a roll pin, screw, cotter pin, etc.), upper roller springs 620, and an upper roller 622.

The upper roller housing contains the upper roller 622 and the upper roller defines a longitudinal axis along a length of the upper roller. A face of the upper roller housing 624 (e.g., a portion of the upper roller housing facing away from the receiver) may be smooth and beveled so that when the upper roller housing pivots on the upper roller pivot it does not contact the lever body 608, extension arm 614, or the lever body extension 612. The upper roller 622 is attached to the upper roller housing at the upper roller axis. The upper roller 622 may have a cylindrical shape, with the upper roller axis extending through the length of the upper roller. The upper roller 622 may be free to rotate about the upper roller axis. The upper roller springs 620 are positioned between the upper roller housing and the lever body extension 612. The upper roller springs 620 provide pressure retaining the upper roller housing in an approximately vertical position. The upper roller housing pivots on the upper roller pivot 618 in only one direction, for example. As the upper roller housing pivots (e.g., the upper roller may swing away from the firearm receiver), the upper roller springs 620 are compressed and will tend to reset the upper roller housing to the approximately vertical position.

The bolt release mechanism 604 includes a lower roller 630, lower roller arms 632, and lower roller push arm housings 634. The lower roller push arm housings 634 may be hollow tubes (of any shape) attached to the device housing and extending away from the receiver 100 of the firearm. The lower roller arms 632 are positioned within the lower push arm housings 634 and are moveable linearly along an axis approximately perpendicular to the firearm receiver 100. The lower roller springs 636 are positioned between the lower roller arms 632 and an inside surface lower roller housing 634. The lower roller springs 636 apply force directed away from the firearm receiver 100 on the lower roller arms 632.

The lower roller 630 is attached to the lower roller arms 632 along the lower roller axis. The lower roller 630 may have a cylinder shape, with the lower roller axis extending through the length of the lower roller 630. The lower roller 630 may be free to rotate about the lower roller axis.

In some implementations, the lower roller 630 may be attached to a single roller arm.

Figure 7:
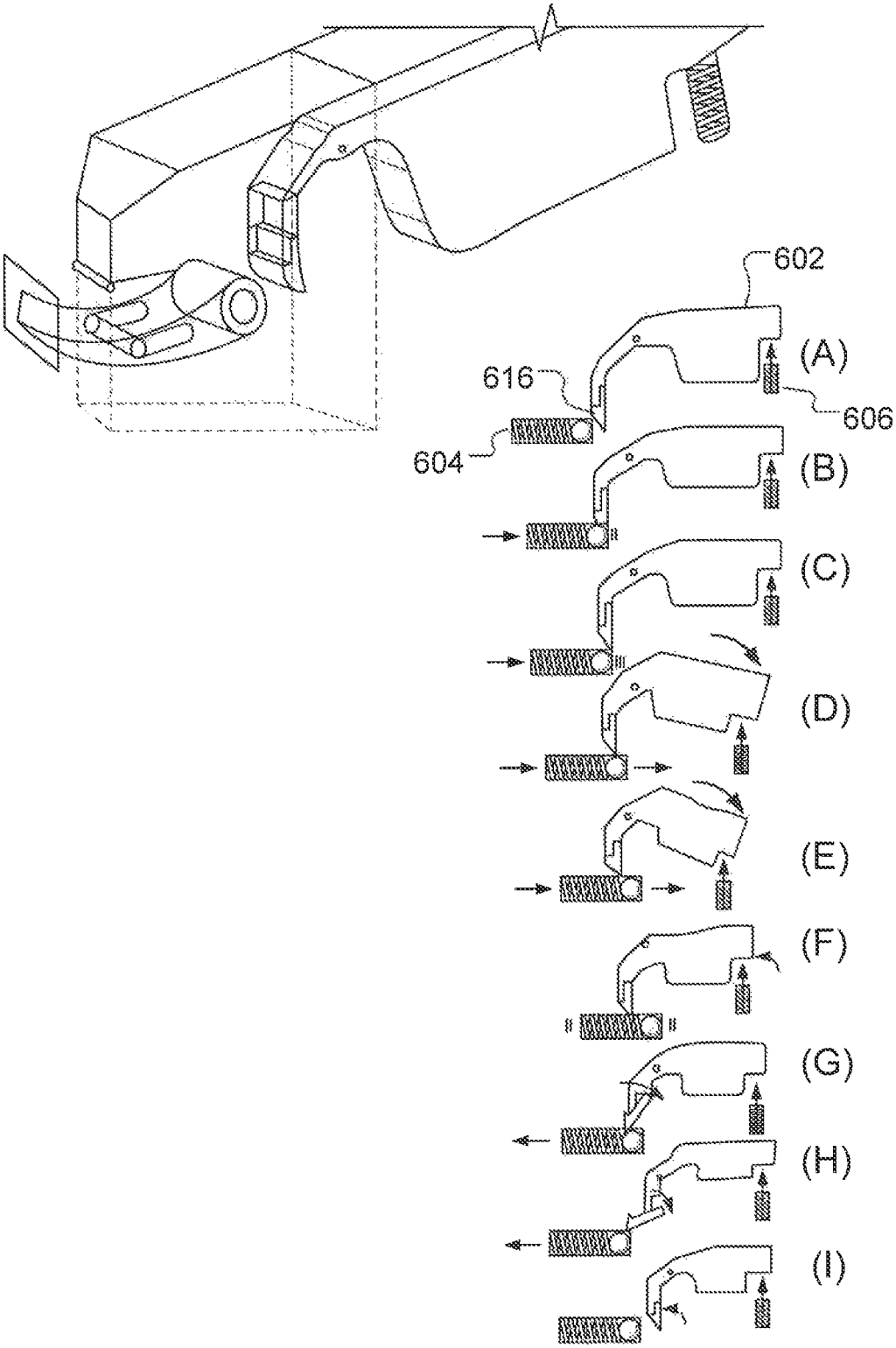
FIG. 7 illustrates an example operation of a series of operation of a third example implementation of a device for converting a semiautomatic firearm to a non-semiautomatic firearm.

FIG. 7 illustrates an example operation of a third example implementation of a device for converting a semiautomatic firearm to a non-semiautomatic firearm. Diagrams (A) through (I) illustrate an example operation of device 600. Beginning with the rest position, diagram (A), the lever body is pushed upward into the path of the bolt by the upward force of the base spring. This holds the bolt in the rearward position after each shot preventing the bolt from feeding a new round into the chamber. In the rest position, the lower roller is positioned a greater distance from the receiver than the upper roller. The lower roller springs force the lower roller arms, and the lower roller away from the receiver, maintaining the lower roller in an outward position. The upper roller housing is maintained in an approximately vertical positon by the upper roller springs.

As shown in diagram (B), the bolt release mechanism is operated by pushing the lower roller arms towards the receiver against the pressure of the lower roller springs. As the lower roller arms move toward the receiver, the lower roller contacts the upper roller, thereby, engaging the bolt release mechanism with the bolt stop lever and operatively coupling the bolt release mechanism and the bolt stop lever. As the user applies more force, the lower roller is pushed past the upper roller, pushing the upper roller in an upward direction, and pivoting the bolt stop lever so that the lever body moves downward (diagrams (C)-(F)). As shown in diagram (E), when the upper and lower roller axes are approximately aligned vertically the bolt stop lever is in a lowered position. When the bolt stop lever is in the lowered position, the bolt is free to return to the forward position (E)) feeding a new round into the chamber in the process.

In diagram (F), the lower roller has been pushed to an inward position. At the inward position, the lower roller has been pushed past the upper roller and positioned at a location relative to the upper roller such that the lower roller is no longer in contact with the upper roller, thereby, disengaging the bolt release mechanism and the bolt stop lever. The bolt release mechanism and the bolt stop lever are thus operatively decoupled. With the lower roller at the inward position, the bolt stop lever pivots back to its upward positon under the force of the base spring. When the user releases the bolt release mechanism, the lower roller springs return the lower roller arms and the lower roller to the outward (rest) position (diagrams (G)-(I)). The lower roller is again pushed past the upper roller, however, as the lower roller contacts the upper roller moving outwards, the upper roller pivots about the upper roller pivot and out of the way of the lower roller. Because of this pivoting action of the upper roller housing, the bolt stop lever remains substantially stationary as the bolt release mechanism is returned to the outward (rest) position. After the lower roller clears the upper roller the upper roller housing the upper roller springs return the upper roller housing to the vertical position (diagram (I)).

The upper roller housing pivots on the upper roller pivot only when a force is applied to the upper roller in a direction away from the receiver (e.g., when the lower roller moves from the inward position to the outward position). The upper roller housing does not pivot when a force is applied to the upper roller in a direction toward the receiver. Instead, the upper roller housing is held against the lever body extension arm and the bolt stop lever pivots.

In some implementations, the upper roller pivot hole is located slightly proximal to the receiver (e.g., not on the centerline of the lever body extension arm, but slightly offset from the centerline). Under such a configuration, the weight of the upper roller housing may return the upper roller housing to the substantially vertical position if the upper roller springs fail.

The combination of the upper and lower roller prevent a user from being able to hold the bolt release lever in the downward position when the firearm is fired. The upper and lower rollers will spin and roll off one another either because the rounded smooth surfaces of the upper and lower rollers will roll off one another or because of the recoil created when the rifle is fired, user from bypassing the disengaging feature of the bolt release mechanism.

The bolt release mechanism as described above is configured such that during a rest state (e.g., absent a user applied force) the upper roller is positioned closer to the receiver than the lower roller. Thus, the bolt release mechanism is operated by pushing the lower roller arms towards the receiver against the pressure of the lower roller springs. In an alternate implementation, the bolt release mechanism may be configured such that during a rest state (e.g., absent a user applied force) the upper roller is positioned further from the receiver than the lower roller. That is, the position of the rollers may be reversed and the bolt release mechanism may be operated by pulling the lower roller arms away from the receiver against the pressure of the lower roller springs (e.g., the position of the lower roller springs and the upper roller housing would also be reversed in such an implementation).

Figure 8:
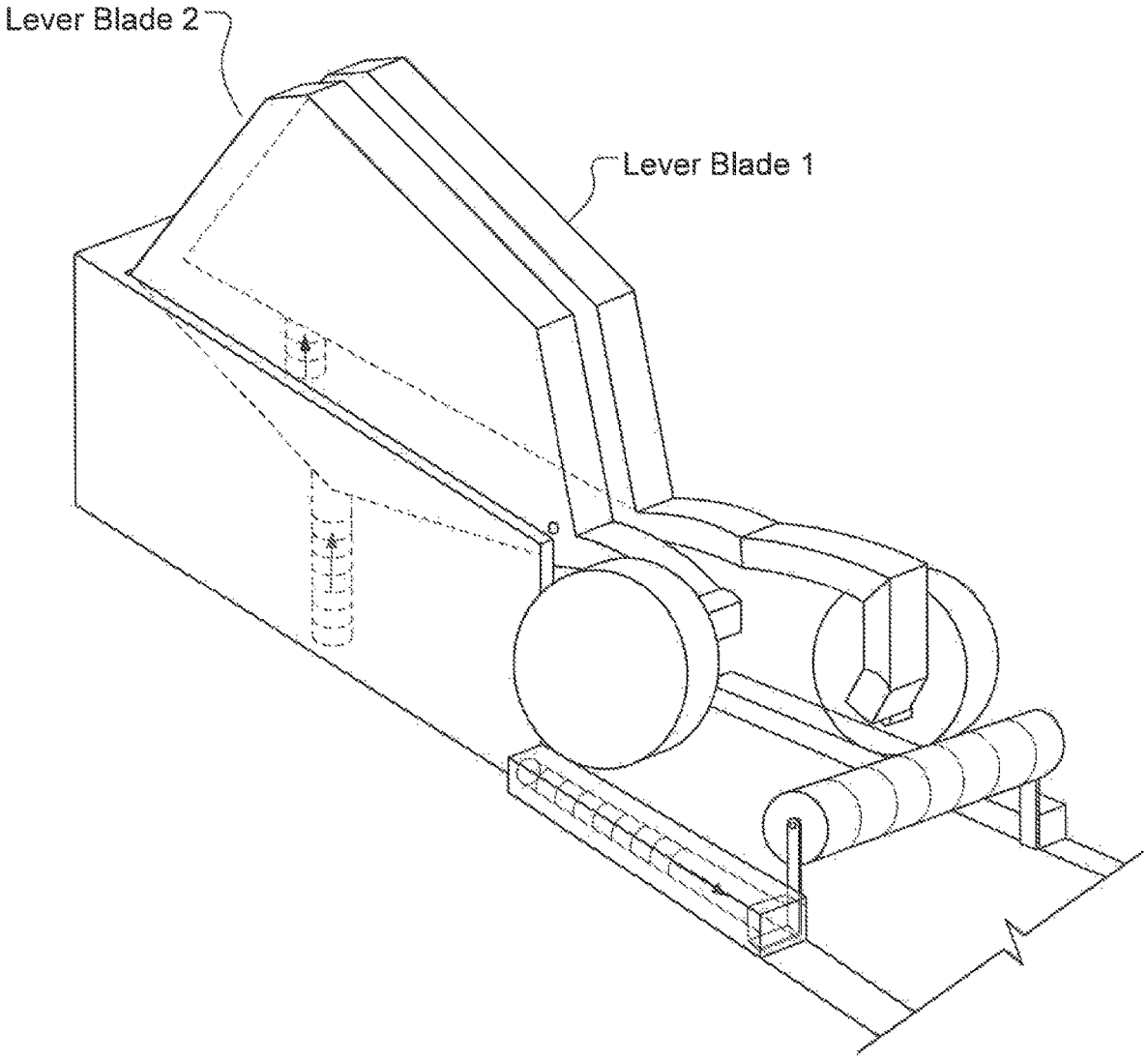
FIG. 8 illustrates a fourth example implementation of a device for converting a semiautomatic firearm to a non-semiautomatic firearm.

FIG. 8 illustrates a fourth example implementation of a device 800 for converting a semiautomatic firearm to a non-semiautomatic firearm. Device 800 is similar to device 600, but includes a double bladed bolt stop lever design (e.g., two independently functioning bolt stop levers referred to as blade 1 and blade 2). Blade 1 and blade 2 may each be similar in design to the bolt stop lever described above with reference to FIGS. 6 and 7. However, blade 1 and blade 2 have lever body extensions of differing lengths and independent base springs. Blade 1 is positioned in a rearward (e.g., away from the barrel of the firearm) location in the bolt catch slot of the receiver and has a longer lever body extension arm than blade 2. Blade 2 is positioned in a forward (e.g., nearer to the barrel of the firearm) location in the bolt catch slot of the receiver and has a shorter lever body extension arm than blade 1. In some implementations, lever body extensions of blade 1 and blade 2 are configured such that the lower roller of the bolt release mechanism may not be in contact with both the upper roller of blade 1 and the upper roller of blade 2 at the same time. For example, a difference between the length of the lever body extension of blade 1 and that of blade 2 is such that a distance between facing surfaces of the upper rollers is greater than the diameter of the lower roller.

In some implementations, one or both of blade 1 and blade 2 may have a fixed upper roller housing. In some implementations, one or both of blade 1 and blade 2 may have a pivotable upper roller housing as described above in reference to device 600.

Figure 9A:
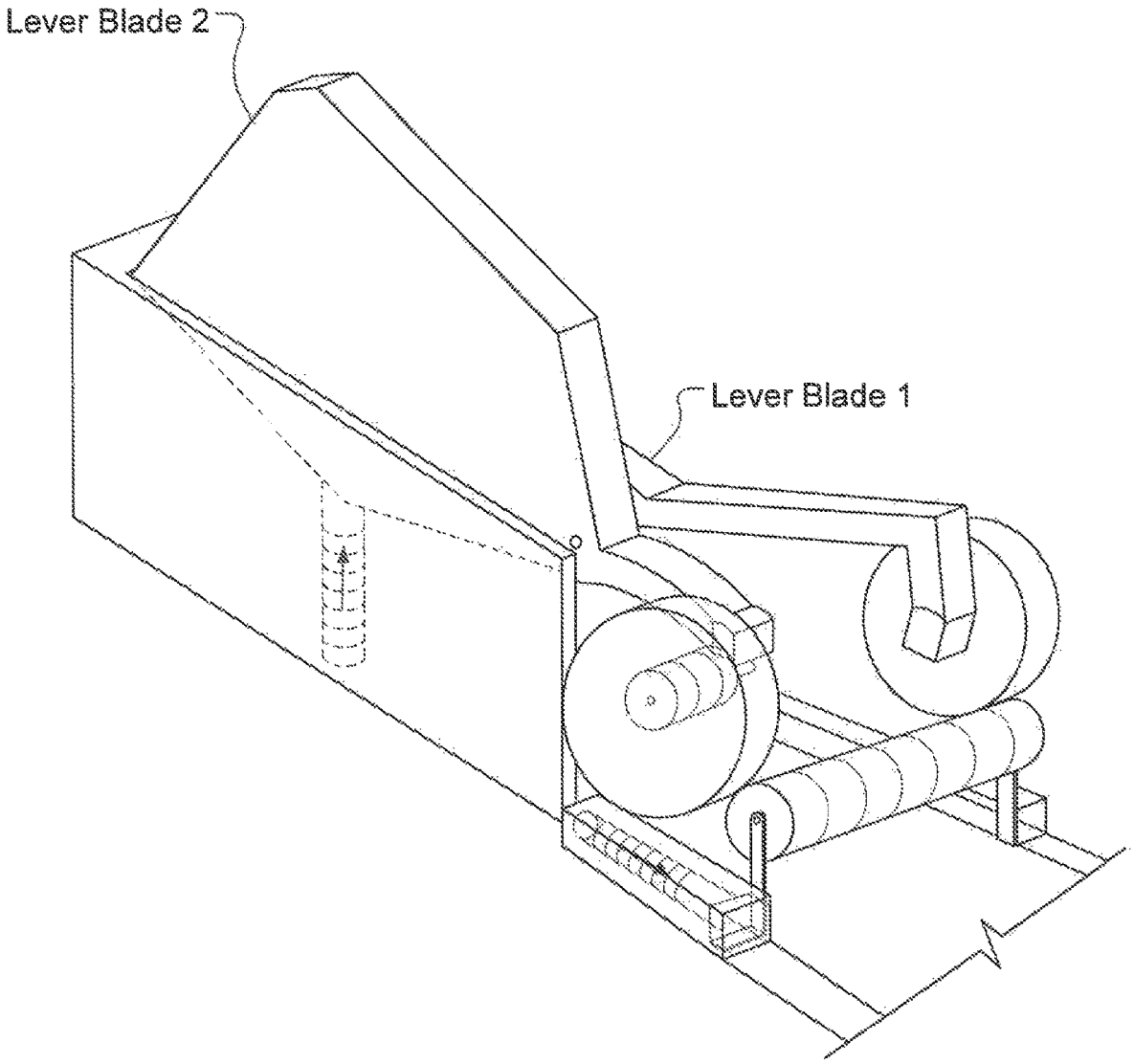
FIGS. 9A-9C illustrate portions of a fourth example implementation of a device for converting a semiautomatic firearm to a non-semiautomatic firearm.
Figure 9B:
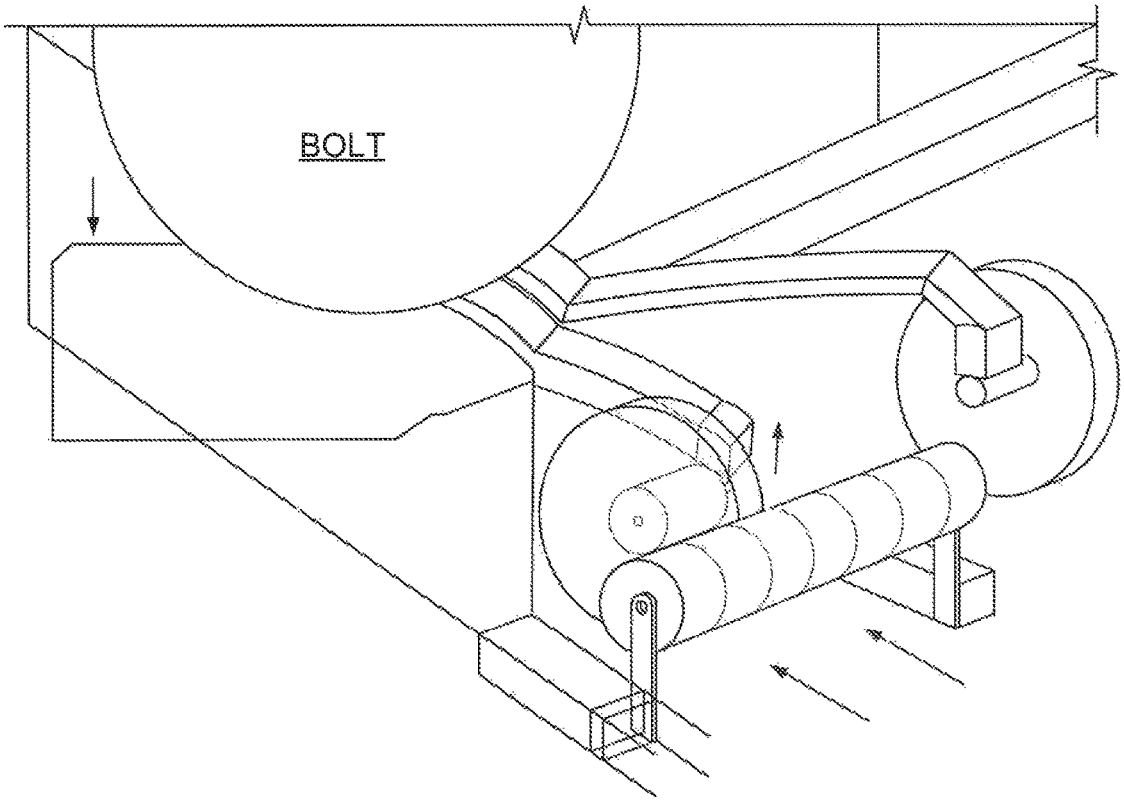
Figure 9C:
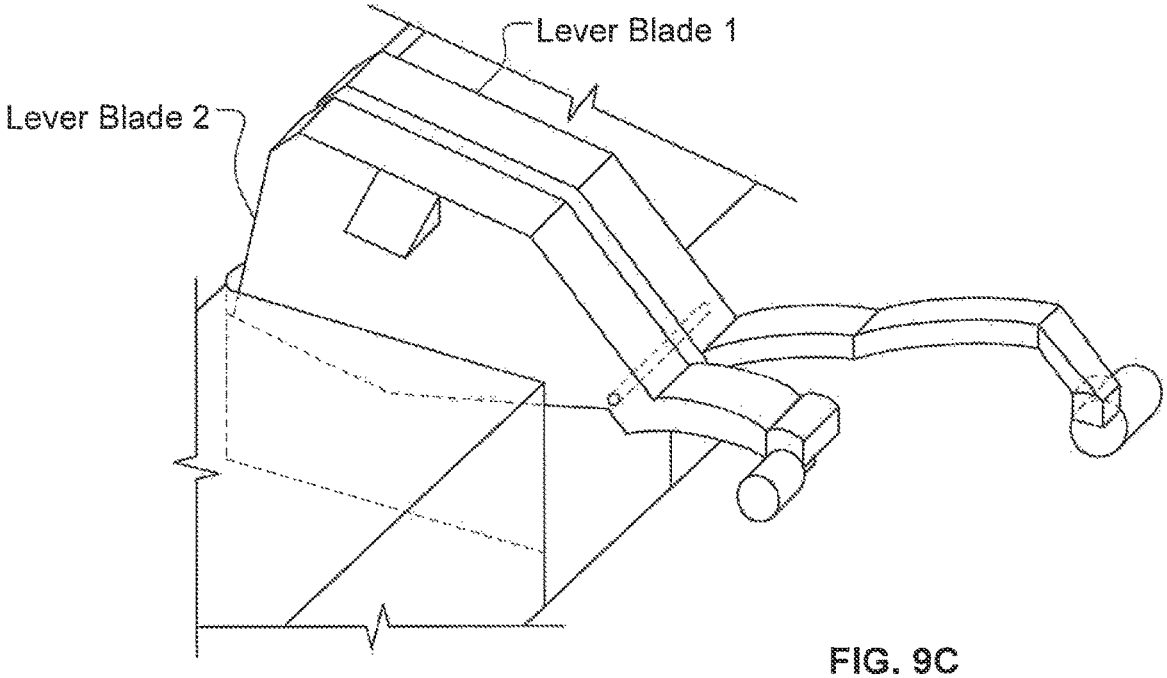

FIGS. 9A-9C illustrate portions of a fourth example implementation of a device for converting a semiautomatic firearm to a non-semiautomatic firearm in more detail.

Figure 10:
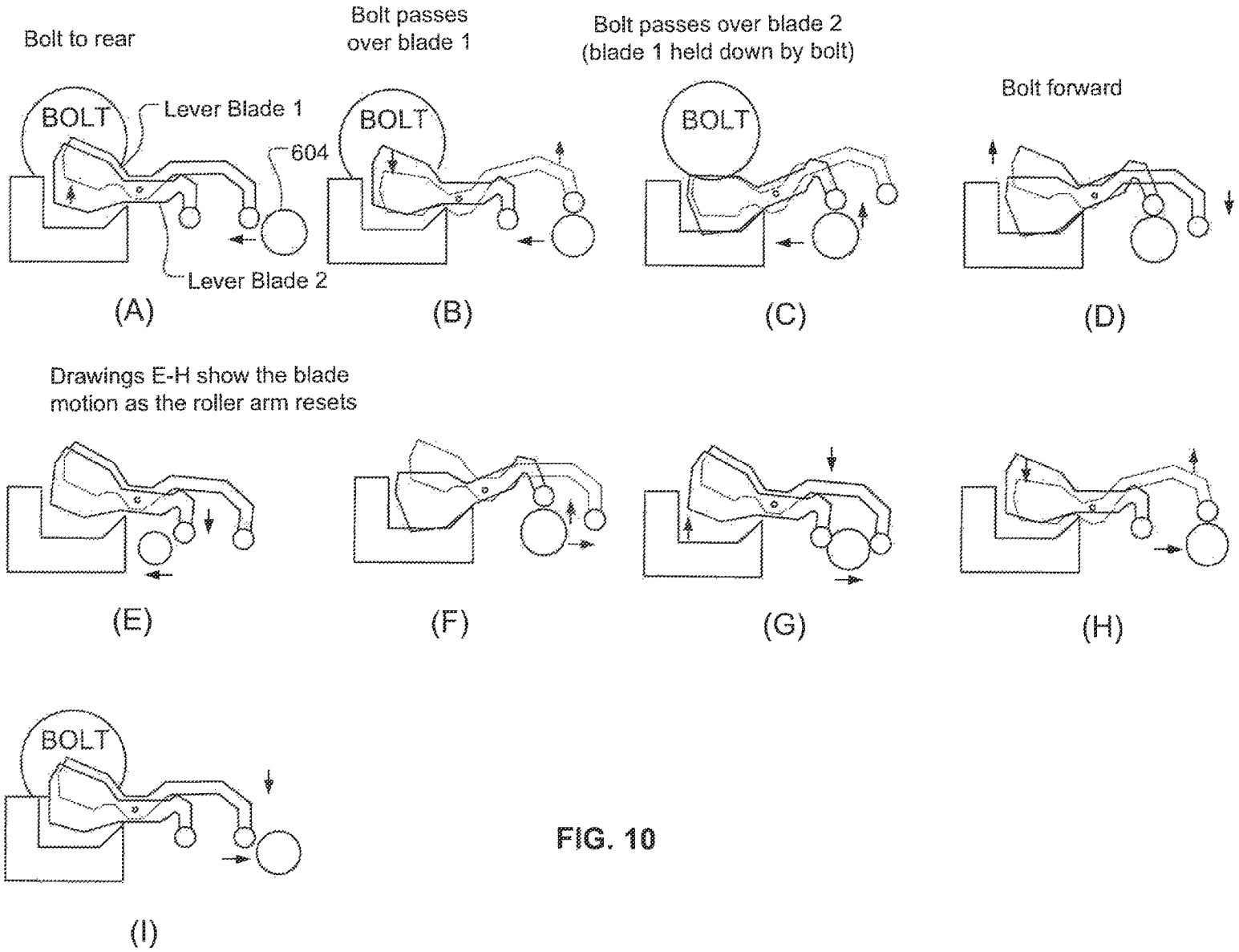
FIG. 10 illustrates an example operation of a series of operation of a fourth example implementation of a device for converting a semiautomatic firearm to a non-semiautomatic firearm.

FIG. 10 illustrates an example operation of a fourth example implementation of a device for converting a semiautomatic firearm to a non-semiautomatic firearm. Diagrams (A) through (C) illustrate an example operation of device 700. Beginning with the rest position, diagram (A), the lever bodies of both blade 1 and blade 2 are pushed upward into the path of the bolt by the upward force of their respective base springs. In this position, the bolt is held in the rearward position after each shot preventing the bolt from feeding a new round into the chamber.

As shown in diagram (B), the bolt release mechanism is operated by pushing the lower roller arms with the lower roller toward the receiver, and against the pressure of the lower roller springs. As the lower roller arms move toward the receiver, the lower roller first contacts the upper roller of the blade 1 (e.g., the rearward blade). The lower roller engages the bolt release mechanism with blade 1 and couples the bolt release mechanism and blade 1 of the bolt stop lever. As the user applies more force, the lower roller is pushed past the upper roller of blade 1 pushing the upper roller of blade 1 in an upward direction, and pivoting blade 1. As blade 1 pivots, the lever body of blade 1 lowers, and the bolt moves forward slightly until being stopped by the still raised blade 2. As the lower roller moves past blade 1 and contacts the upper roller of blade 2 (diagram (C)), blade 1 remains in a lowered position because the bolt, now resting above blade 1, prevents bolt 1 from pivoting back to the fully upward position, but blade 1 is again biased upward by its respective base spring. In addition, the lower roller comes into contact with the upper roller of blade 2 and, as with blade 1, pushes the upper roller of blade 2 in an upward direction, and pivots blade 2. As blade 2 pivots, the lever body of blade 2 lowers and the bolt is allowed to move forward into battery, thereby feeding a new round into the chamber of the firearm in the process.

When the user releases the bolt release mechanism, as with the device 600, the lower roller springs will push the lower push arms and the lower roller back to the outward position. Both blade 1 and blade 2 will then pivot into the upward position, into the path of the bolt. When the user fires the firearm, the bolt will cycle back to the rearward position. When the bolt passes blade 2 and blade 1 traveling rearward, the bolt will push the beveled edge of blade 2 down and out of the bolt's path, and then push the beveled edge of blade 1 down and out of the bolt's path. After the bolt has traveled completely to the rear and passed over both blades, the lever body of blade 2 will pivot upwards first followed by the lever body of blade 1. When the bolt begins to travel forward again, the bolt will again be held in the rearward position preventing the chambering of another round.

A device for converting a semiautomatic firearm to a non-semiautomatic firearm as described in any of the implementations above may be contained in a housing. In such an implementation the bolt stop lever, bolt release mechanism, and base spring may be pre-assembled within the housing, thus forming a "drop-in" design. The lever pivot may be hollow and slightly larger in diameter than the holes in the receiver protrusions. A user may then install the device by placing the housing in a bolt catch slot of a fire arm receiver and inserting a fastener (e.g., a retaining pin) through the receiver protrusions and the hollow portion of the lever pivot. In addition, a portion of the housing may form a shroud around any portion of the bolt stop lever that is external to the firearm receiver. The shroud may prevent a user from operating the bolt stop lever by pushing or pulling the bolt stop lever directly, thereby, requiring the user to operate the bolt stop lever by use of the bolt release mechanism. Thus, a user may not be able to override the disengagement feature of the bolt release mechanism.

Similarly, a device for converting a semiautomatic firearm to a non-semiautomatic firearm as described in any of the implementations above may include a bolt stop lever shaped to have a minimal portion of the bolt stop lever external to the receiver. Such a design may prevent a user from operating the bolt stop lever by pushing or pulling the bolt stop lever directly, thereby, requiring the user to operate the bolt stop lever by use of the bolt release mechanism. Again preventing a user from overriding the disengagement feature of the bolt release mechanism.

Figure 11:
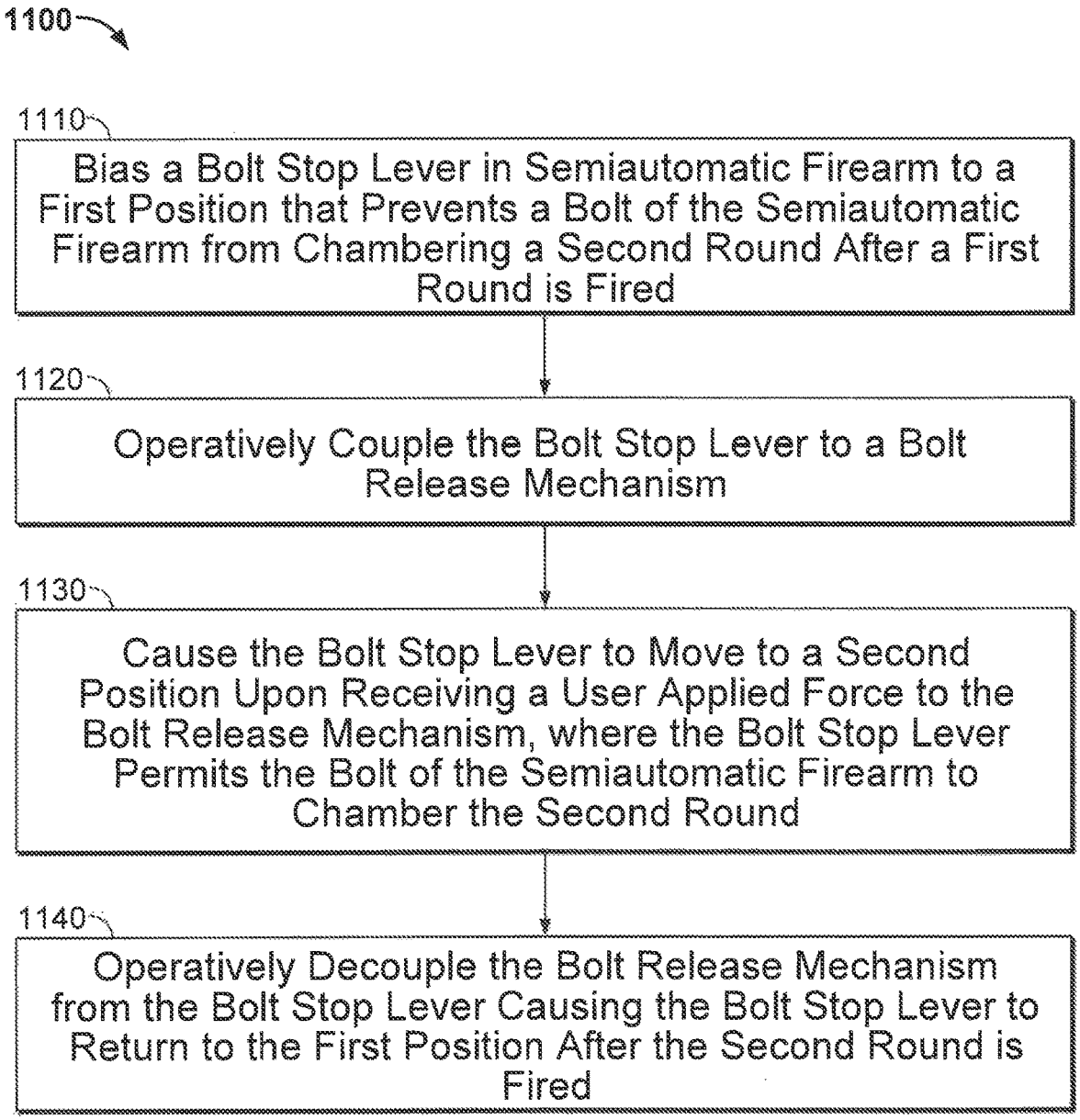
FIG. 11 is a flow chart of an example process for converting a semiautomatic firearm to a non-semiautomatic firearm.

FIG. 11 is a flow chart of an example process 1100 for converting a semiautomatic firearm to a non-semiautomatic firearm. Process 1100 can be performed by any of the above described implementations of a device for converting a semiautomatic firearm to a non-semiautomatic firearm. In some implementations, a device for converting a semiautomatic firearm to a non-semiautomatic firearm may be an assembly configured to perform process 1100 (e.g., an assembly of one or more of the components described above and contained in a housing).

A bolt stop lever in a semiautomatic firearm is biased to a first position (1110). The first position of the bolt stop lever prevents a bolt of the semiautomatic firearm from chambering a second round after a first round is fired. For example, the bolt stop lever of a semiautomatic firearm may be biased by a spring into a position that will prevent a bolt moving in one or more directions to feed an unfired round into a chamber of the firearm.

The bolt stop lever is operatively coupled to a bolt release mechanism (1120). For example, the bolt stop lever can move to a second position upon receiving a user applied force to the bolt release mechanism (1130). In the second position, the bolt stop lever permits the bolt of the semiautomatic firearm to chamber the second round. For example, the bolt may be returned to battery by a spring (e.g., a buffer spring, or a guide spring) of the firearm. The bolt release mechanism is operatively decoupled from the bolt stop lever causing the bolt stop lever to return to the first position after the second round is fired (1140). For example, when in battery the bolt may prevent the bolt stop lever from fully returning to the second position, however, because the bolt stop lever is biased to the first position, the bolt stop lever may fully return to the first positon when the bolt cycles after firing the second round.

In some implementations, the bolt release mechanism may be automatically reset by one or more springs (e.g., reset springs). In some implementations, resetting the bolt release mechanism may include returning the bolt release mechanism to a rest position. In some implementations, resetting the bolt release mechanism may include operatively recoupling the bolt release mechanism to the bolt stop lever.

The use of terminology such as "front," "back," "top," "bottom," "over," "above," and "below" throughout the specification and claims is for describing the relative positions of various components of the system and other elements described herein. Similarly, the use of any horizontal or vertical terms to describe elements is for describing relative orientations of the various components of the system and other elements described herein. Unless otherwise stated explicitly, the use of such terminology does not imply a particular position or orientation of the system or any other components relative to the direction of the Earth gravitational force, or the Earth ground surface, or other particular position or orientation that the system other elements may be placed in during operation, manufacturing, and transportation.

A number of implementations have been described. Nevertheless, it will be understood that various modifications may be made. For example, advantageous results may be achieved if the steps of the disclosed techniques were performed in a different sequence, if components in the disclosed systems were combined in a different manner, or if the components were replaced or supplemented by other components. Accordingly, other implementations are within the scope of the following claims.

What is claimed is:

1. A method for converting a semiautomatic firearm to a non-semiautomatic firearm, the method comprising:

providing an assembly for installation into a semiautomatic firearm, wherein the assembly, when installed in the semiautomatic firearm, is configured to:

bias a bolt stop lever in a first position, wherein in the first position the bolt stop lever prevents a bolt of the semiautomatic firearm from chambering a second round after a first round is fired;

operatively couple the bolt stop lever to a bolt release mechanism;

cause the bolt stop lever to move to a second position upon receiving an applied force to the bolt release mechanism, wherein in the second position the bolt stop lever permits the bolt of the semiautomatic firearm to chamber the second round; and operatively decouple the bolt release mechanism from the bolt stop lever causing the bolt stop lever to return to the first position.

2. The method of claim 1, wherein the assembly includes a spring configured to be installed in contact with the bolt stop lever and a receiver of the semiautomatic firearm such that the spring exerts a force on the bolt stop lever to bias the bolt stop lever in the first position.

3. The method of claim 1, wherein the bolt release mechanism is operatively coupleable to the bolt stop lever by one or more detent and protrusion pairs.

4. The method of claim 1, wherein one of the bolt release mechanism and the bolt stop lever comprises a detent and the other of the bolt release mechanism and the bolt stop lever comprises a protrusion configured to engage the detent, and wherein the bolt release mechanism is configured to operatively decouple from the bolt stop lever by the disengagement of the detent and the protrusion.

5. The method of claim 1, wherein the assembly, when installed in the semiautomatic firearm, is further configured to operatively recouple the bolt release mechanism to the bolt stop lever when the applied force is removed from the bolt release mechanism.

6. The method of claim 5, wherein the assembly includes a spring configured to be installed between the bolt stop lever and the bolt release mechanism such that the spring exerts a force on the bolt release mechanism to cause the bolt release mechanism to operatively recouple to the bolt stop lever when the applied force is removed from the bolt release mechanism.

7. A method for converting a semiautomatic firearm to a non-semiautomatic firearm, the method comprising:

installing an assembly into a semiautomatic firearm, wherein the assembly, when installed in the semiautomatic firearm, is configured to:

bias a bolt stop lever in a first position, wherein in the first position the bolt stop lever prevents a bolt of the semiautomatic firearm from chambering a second round after a first round is fired;

operatively couple the bolt stop lever to a bolt release mechanism;

cause the bolt stop lever to move to a second position upon receiving an applied force to the bolt release mechanism, wherein in the second position the bolt stop lever permits the bolt of the semiautomatic firearm to chamber the second round; and operatively decouple the bolt release mechanism from the bolt stop lever causing the bolt stop lever to return to the first position.

8. The method of claim 6, further comprising installing a spring between the bolt stop lever and a receiver of the semiautomatic firearm such that the spring exerts a force on the bolt stop lever to bias the bolt stop lever in the first position.

9. The method of claim 6, wherein the bolt release mechanism is operatively coupleable to the bolt stop lever by one or more detent and protrusion pairs.

10. The method of claim 6, wherein one of the bolt release mechanism and the bolt stop lever comprises a detent and the other of the bolt release mechanism and the bolt stop lever comprises a protrusion configured to engage the detent, and wherein the bolt release mechanism is configured to operatively decouple from the bolt stop lever by the disengagement of the detent and the protrusion.

11. The method of claim 6, wherein the assembly, when installed in the semiautomatic firearm, is further configured to operatively recouple the bolt release mechanism to the bolt stop lever when the applied force is removed from the bolt release mechanism.

12. The method of claim 6, further comprising installing a spring between the bolt stop lever and the bolt release mechanism such that the spring exerts a force on the bolt release mechanism to cause the bolt release mechanism to operatively recouple to the bolt stop lever when the applied force is removed from the bolt release mechanism.

* * * * *